United States Patent [19]

Watanabe et al.

[11] 4,246,027

[45] Jan. 20, 1981

[54] HIGH-DENSITY SINTERED BODIES WITH HIGH MECHANICAL STRENGTHS

[75] Inventors: Tadahiko Watanabe, Saga; Katsushige Nakazono, Jojima; Yunosuke Tokuhiro, Saga, all of Japan

[73] Assignee: Director-General of the Agency of Industrial Science and Technology, Tokyo, Japan

[21] Appl. No.: 973,957

[22] Filed: Mar. 23, 1979

[51] Int. Cl.[3] ..... C22C 29/00; C22C 1/05; B22F 3/14

[52] U.S. Cl. ..... 75/244; 75/202; 75/226

[58] Field of Search ..... 75/202, 244, 226

[56] References Cited

U.S. PATENT DOCUMENTS

| | | | |
|---|---|---|---|
| 2,996,793 | 8/1961 | Jayne | 75/244 |
| 3,256,072 | 6/1966 | Bull et al. | 75/244 |
| 3,954,419 | 5/1976 | Kaufman et al. | 75/202 |

*Primary Examiner*—Brooks H. Hunt

[57] ABSTRACT

A novel sintered body suitable for use as a refractory or abrasive material is proposed with high mechanical strengths and hardness even at elevated temperatures. The sintered body of the invention is prepared by subjecting a powder mixture composed of titanium diboride as the base component, a nickel phosphide or nickel-phosphorus alloy and a third component selected from metals of chromium, molybdenum, niobium, tantalum, hafnium, rhenium and aluminum as well as diborides thereof, and the inventive sintered bodies are very advantageous in their industrial production owing to the relatively low sintering temperature of 2000° C. or lower and in their high performance at elevated temperatures to find wide applications in the fields of high-temperature engineering and as a material for the high-speed cutting tools.

10 Claims, No Drawings

HIGH-DENSITY SINTERED BODIES WITH HIGH MECHANICAL STRENGTHS

BACKGROUND OF THE INVENTION

The present invention relates to a novel sintered body suitable for use as a refractory or abrasive material with its high mechanical strengths at elevated temperatures.

In the prior art, various kinds of sintered bodies are employed for manufacturing certain structural materials suitable for use for rocket housings, turbine blades, high-speed cutting tools and the like, in which high mechanical strengths, e.g. flexural strength and hardness, are essential even at extremely high temperatures. As is well known, a class of such sintered bodies is composed of titanium diboride ($TiB_2$) as the basic component utilizing its high melting point, hardness and mechanical strengths at elevated temperatures. These $TiB_2$-based sintered bodies are usually prepared by sintering a binary powder mixture composed of $TiB_2$ as the main component and a second component including a powder of a metal such as chromium, molybdenum, rhenium and the like, a metal diboride such as chromium diboride ($CrB_2$), Zirconium diboride ($ZrB_2$) and the like, and a nickel phosphide or a nickel-phosphorus alloy (hereinafter denoted as Ni.P).

The above described binary sintered bodies, however, have their respective drawbacks in their performance as well as in their preparation. For example, an extremely high sintering temperature of 2000° C. or higher is required for the sintering of the $TiB_2$-metal, e.g. $TiB_2$-chromium, $TiB_2$-molybdenum and $TiB_2$-rhenium, binary sintered bodies giving rise to a very hard difficulty in the production of industrial scale. In addition, these $TiB_2$-metal binary sintered bodies suffer from their relatively low flexural strengths in the range of, for example, 40–50 kg/mm$^2$. The $TiB_2$-metal diboride, e.g. $TiB_2$-chromium diboride and $TiB_2$-zirconium diboride, binary sintered bodies are also subject to the drawbacks of the high sintering temperature and the relatively low flexural strength along with the low relative density, i.e. the ratio of the apparent density to the true density of the sintered body.

The sintering temperature of the $TiB_2$-Ni.P binary sintered body, on the other hand, may be as low as ranging from 1000° to 1600° C. and a satisfactorily high flexural strength of around 100 kg/mm$^2$ is readily obtained with these binary sintered bodies (see, for example, Japanese Patent Disclosure No. SHO 52-106306). The binary sintered bodies of this class have, however, rather poor heat resistance and cannot be used at a temperature exceeding the melting point of the Ni.P, viz. 890° C.

Thus, there have hitherto been known no satisfactory refractory or abrasive material which is a high-density, high-strength and heat-resistant sintered body of $TiB_2$ as the main component easily manufactured even with a not excessively high sintering temperature.

SUMMARY OF THE INVENTION

An object of the present invention is therefore to present a novel sintered body containing titanium diboride ($TiB_2$) as the main component and suitable for use as a high-temperature refractory material or an abrasive material with excellent mechanical strengths at an elevated temperature but obtained with a relatively low sintering temperature.

Another object of the present invention is to present a ternary sintered body composed of $TiB_2$, Ni.P and a third component selected from the group consisting of metals of chromium, molybdenum, niobium, tantalum, hafnium, rhenium and aluminum as well as diborides thereof and a method for producing the same.

To be more specific, the Ni.P used in the present invention is an alloy of nickel and phosphorus containing 3 to 25% by weight of phosphorus based on nickel and the amount of Ni.P to be formulated in the ternary mixture is in the range of from 0.5 to 15 parts by weight per 100 parts by weight of $TiB_2$ and the amount of the third component is in the range of from 1 to 95 parts by weight per 100 parts by weight of $TiB_2$.

The ternary sintered body of the invention is prepared by the techniques of hot-pressing under a pressure of 50–300 kg/cm$^2$ at a temperature of 1500°–2000° C. for 10–60 minutes or by sintering a green shaped body of the powder mixture under the above sintering conditions of temperature and time.

DETAILED DESCRIPTION OF THE PREFERRED EMBODIMENTS

The base component of the inventive ternary sintered body as defined above is titanium diboride expressed by the chemical formula $TiB_2$ which is a well-known refractory material melting at 2980° C. and having a specific gravity of about 4.50 and a very high hardness suitable for use as an abrasive material. There is no specific limitation on the property of this $TiB_2$ insofar as a satisfactorily high purity is ensured. It is preferable that the $TiB_2$ has a particle size distribution as fine as possible in order to obtain a uniform blending with the other components.

The second component in the inventive ternary sintered body is a nickel phosphide or an alloy of nickel and phosphorus containing 3 to 25% or, preferably, 5 to 15% by weight of phosphorus based on the nickel content. This component may not necessarily be a ready-prepared Ni.P but, instead, powders of nickel metal and phosphorus can also be used in combination to be blended with the other components. The amount of Ni.P in the ternary mixture is in the range from 0.5 to 15 parts by weight per 100 parts by weight of the $TiB_2$ since smaller amounts than 0.5 parts by weight result in insufficient mechanical strengths while excessively high amounts over 15 parts by weight lead to a poorer heat resistance of the sintered body.

The third component is a powder of a certain metal exemplified by chromium, molybdenum, niobium, tantalum, hafnium, rhenium and aluminum or a diboride thereof, i.e. $CrB_2$, $MoB_2$, $NbB_2$, $TaB_2$, $HfB_2$, $ReB_2$ or $AlB_2$. These metal powders or metal borides may be used either singly or as a combination of two or more. The amount of this third component is in the range from 1 to 95 parts by weight per 100 parts by weight of the $TiB_2$. It is recommended that, when this third component is a powder of the above named metals, the amount is limited to 1 to 10 parts by weight per 100 parts by weight of the $TiB_2$ while the metal borides are used preferably in an amount from 3 to 95 parts by weight per 100 parts by weight of the $TiB_2$.

The ternary sintered body of the present invention is prepared by first blending the three components in fine powder forms intimately into a powder mixture with which a mold made of, for example, graphite is packed and subsequently sintering by the techniques of hot-pressing of the powder mixture is conducted in vacuum or in an atmosphere of a reducing gas such as hydrogen under a pressure of 50–300 kg/cm$^2$ at a temperature of 1500°–2000° C. for 10–60 minutes. Alternatively, a green body shaped by compression molding in advance with the above powder mixture is subsequently subjected to sintering in vacuum or in an atmosphere of a reducing gas at a temperature of 1500°–2000° C. to give a sintered body with almost identical properties as in the hot-pressing.

The combinations of the three components including the cases where the third component per se is a mixture of two or more of the metals or metal diborides are given below as to be exemplary:

$TiB_2$-Ni.P-Cr; $TiB_2$-Ni.P-Mo; $TiB_2$-Ni.P-Ta; $TiB_2$-Ni.P-Re; $TiB_2$-Ni.P-Nb; $TiB_2$-Ni.P-Mo-Ta; $TiB_2$-Ni.P-Mo-Re; $TiB_2$-Ni.P-Mo-Nb; $TiB_2$-Ni.P-Ta-Re; $TiB_2$-Ni.P-Ta-Nb; $TiB_2$-Ni.P-Re-Nb; $TiB_2$-Ni.P-Mo-Ta-Re-Nb; $TiB_2$-Ni.P-$CrB_2$; $TiB_2$-Ni.P-$AlB_2$; $TiB_2$-Ni.P-$TaB_2$; $TiB_2$-Ni.P-$HfB_2$; $TiB_2$-Ni.P-$CrB_2$-$AlB_2$; $TiB_2$-Ni.P-$CrB_2$-$TaB_2$; $TiB_2$-Ni.P-$CrB_2$-$HfB_2$; $TiB_2$-Ni.P-$AlB_2$-$TaB_2$; $TiB_2$-Ni.P-$AlB_2$-$HfB_2$; $TiB_2$-Ni.P-$TaB_2$-$HfB_2$; and $TiB_2$-Ni.P-$CrB_2$-$AlB_2$-$TaB_2$-$HfB_2$.

The sintered bodies obtained with the above combinations of the components are excellent in the relative density, mechanical strengths, hardness and heat resistance and suitable as a refractory material and anti-abrasive material as well as a material for high-speed cutting tools.

Following are examples to illustrate the present invention in further detail. In the examples, parts are all given by parts by weight.

EXAMPLE 1 (EXPERIMENT NO. 1 TO NO. 5)

Ternary mixtures of $TiB_2$, Ni.P and a powder of chromium metal in proportions as indicated in Table 1 below were each subjected to sintering by hot-pressing in a graphite mold in vacuum for 15 minutes with the conditions of the sintering temperature and pressure as shown in the table. The apparent density, flexural strength and Vickers hardness of these sintered bodies are set out in the table. The results were almost identical when sintering was carried out in an atmosphere of hydrogen gas.

TABLE 1

| Exp. No. | Parts per 100 parts of $TiB_2$ Ni . P | Cr | Sintering Temperature, °C. | Pressure, kg/cm$^2$ | Apparent density, g/cm$^3$ | Flexural strength, kg/mm$^2$ | Vickers hardness, kg/mm$^2$, at room temperature | at 1000° C. |
|---|---|---|---|---|---|---|---|---|
| 1 | 3 | 5 | 1700 | 120 | 4.58 | 70 | 2000 | 1200 |
| 2 | 3 | 5 | 1600 | 200 | 4.39 | 60 | 1800 | a) |
| 3 | 3 | 5 | 1500 | 200 | 4.00 | 50 | 1600 | a) |
| 4 | 1 | 9 | 1700 | 200 | 4.60 | 60 | 1750 | b) |
| 5 | 1 | 9 | 1600 | 200 | 4.40 | 50 | 1600 | b) |

a) About ½ of the value at room temperature
b) About ⅓ of the value at room temperature

EXAMPLE 2 (EXPERIMENT NO. 6)

The same powder mixture as used in Experiments No. 1 to No. 3 in Example 1 above was shaped into a green body by compression molding in cold and the shaped body was subjected subsequently to sintering by heating in vacuum at 1800° C. for 60 minutes. The thus obtained sintered body had an apparent density of 4.50 g/cm$^3$, flexural strength of 60 kg/mm$^2$, Vickers hardness at room temperature of 1750 kg/mm$^2$ and Vickers hardness at 1000° C. equal to about a half of the value at room temperature.

EXAMPLE 3 (EXPERIMENT NO. 7)

A ternary powder mixture composed of 100 parts of a $TiB_2$ powder, 1 part of Ni.P containing 8% by weight of phosphorus and 5 parts of a chromium diboride powder intimately blended was subjected to sintering by hot-pressing in a graphite mold in an atmosphere of hydrogen gas under a pressure of 165 kg/cm$^2$ at 1800° C. for 30 minutes. The resultant sintered body had a relative density of 99.9%, flexural strength of 75 kg/mm$^2$, Vickers hardness at room temperature of 2500 kg/mm$^2$ and Vickers hardness at 1000° C. of 2000 kg/mm$^2$. The results were almost identical when sintering was carried out in vacuum instead of hydrogen atmosphere.

EXAMPLE 4 (EXPERIMENTS NO. 8 TO NO. 23)

Powder mixtures each composed of 100 parts of $TiB_2$, 1 part of Ni.P containing 8% by weight of phosphorus and one or more of metal borides selected from chromium diboride, aluminum diboride, tantalum diboride and hafnium diboride in amounts as indicated in Table 2 below were subjected to sintering by hot-pressing in the same manner as in the preceding example. Details of the preparation and the properties of the sintered bodies thus obtained are summarized in the table.

TABLE 2

| Exp. No. | Third component (parts) | Sintering Temperature, °C. | Pressure, kg/cm$^2$ | Atmosphere | Relative density, % | Flexural strength, kg/mm$^2$ | Vickers hardness, kg/mm$^2$, at room temperature | at 1000° C. |
|---|---|---|---|---|---|---|---|---|
| 8 | $CrB_2$(3) | 1900 | 200 | Vacuum | 99.9 | 80 | 2600 | 2200 |
| 9(c) | $CrB_2$(5) | 2000 | 0 | Vacuum | 99.5 | 70 | 2400 | 2000 |
| 10 | $AlB_2$(5) | 1800 | 165 | Vacuum | 99.0 | 80 | 2200 | 1750 |
| 11 | $AlB_2$(50) | 1800 | 165 | Vacuum | 99.9 | 80 | 1800 | 1300 |
| 12(c) | $AlB_2$(5) | 2000 | 0 | Vacuum | 99.0 | 70 | 2100 | 1700 |
| 13 | $TaB_2$(5) | 1800 | 165 | Vacuum | 98.0 | 80 | 1800 | 1350 |
| 14 | $TaB_2$(5) | 1800 | 165 | Hydrogen | 98.0 | 75 | 1800 | 1300 |
| 15(c) | $TaB_2$(5) | 2000 | 0 | Vacuum | 99.0 | 75 | 1800 | 1350 |
| 16 | $HfB_2$(5) | 1800 | 165 | Vacuum | 99.5 | 80 | 1900 | 1400 |
| 17 | $CrB_2$(5) + | 1800 | 200 | Vacuum | 99.9 | 85 | 2100 | 1800 |

TABLE 2-continued

| Exp. No. | Third component (parts) | Sintering Temperature, °C. | Sintering Pressure, kg/cm² | Sintering Atmosphere | Relative density, % | Flexural strength, kg/mm² | Vickers hardness, kg/mm², at room temperature | Vickers hardness, kg/mm², at 1000° C. |
|---|---|---|---|---|---|---|---|---|
| | $AlB_2$(5) | | | | | | | |
| 18 | $CrB_2$(5) + $TaB_2$(5) | 1800 | 200 | Vacuum | 99.9 | 80 | 2300 | 1700 |
| 19 | $CrB_2$(5) + $HfB_2$(5) | 1800 | 200 | Vacuum | 99.8 | 85 | 2400 | 1870 |
| 20 | $AlB_2$(5) + $TaB_2$(5) | 1800 | 200 | Vacuum | 99.8 | 83 | 2000 | 1660 |
| 21 | $AlB_2$(5) + $HfB_2$(5) | 1800 | 200 | Vacuum | 99.9 | 83 | 1800 | 1580 |
| 22 | $TaB_2$(5) + $HfB_2$(5) | 1800 | 200 | Vacuum | 99.9 | 85 | 1800 | 1470 |
| 23 | $CrB_2$(5) + $AlB_2$(5) + $TaB_2$(5) + $HfB_2$(5) | 1800 | 200 | Vacuum | 99.9 | 85 | 2000 | 1850 |

[c]Green bodies shaped in advance by compression-molding in cold were sintered.

EXAMPLE 5 (EXPERIMENTS NO. 24 TO NO. 37)

Powder mixtures each composed of 100 parts of a $TiB_2$ powder, 1 part of the same Ni.P powder as used in Example 3 and one or more of metal powders selected from molybdenum, tantalum, niobium and rhenium in amounts as indicated in Table 3 below were subjected to sintering by hot-pressing under the conditions given in the table. The properties of the resultant sintered bodies are set out in the same table.

EXAMPLE 6 (EXPERIMENT NO. 38)

A powder mixture composed of 100 parts of a $TiB_2$ powder, 1 part of the same Ni.P powder as used in Example 3, 5 parts of a powder of chromium diboride and 5 parts of a powder of molybdenum metal intimately blended was subjected to sintering by hot-pressing in a graphite mold in vacuum under a pressure of 165 kg/cm² at 1800° C. for 30 minutes. The resultant sintered body had a relative density of 99.9%, flexural strength of 85 kg/mm², Vickers hardness at room temperature of 2400 kg/mm² and Vickers hardness at 1000° C. of 1630 kg/mm².

TABLE 3

| Exp. No. | Third component (parts) | Sintering Temperature, °C. | Sintering Pressure, kg/cm² | Sintering Atmosphere | Relative density, % | Flexural strength, kg/mm² | Vickers hardness, kg/mm², at room temperature | Vickers hardness, kg/mm², at 1000° C. |
|---|---|---|---|---|---|---|---|---|
| 24 | Mo(5) | 1800 | 165 | Hydrogen | 99.9 | 81 | 2000 | 1500 |
| 25 | Mo(3) | 1900 | 200 | Vacuum | 99.9 | 80 | 2100 | 1570 |
| 26[c] | Mo(5) | 2000 | 0 | Vacuum | 99.4 | 75 | 2000 | 1500 |
| 27 | Ta(5) | 1800 | 165 | Vacuum | 99.8 | 80 | 2000 | 1350 |
| 28 | Re(5) | 1800 | 165 | Vacuum | 99.7 | 80 | 2100 | 1660 |
| 29 | Nb(5) | 1800 | 165 | Vacuum | 99.8 | 80 | 2100 | 1580 |
| 30[c] | Re(5) | 2000 | 0 | Vacuum | 99.7 | 75 | 2000 | 1600 |
| 31 | Mo(3)+Ta(3) | 1800 | 200 | Vacuum | 99.8 | 80 | 1900 | 1300 |
| 32 | Mo(3)+Re(3) | 1800 | 200 | Vacuum | 99.9 | 78 | 2000 | 1330 |
| 33 | Ta(3)+Mo(3)+Nb(3) | 1800 | 200 | Vacuum | 99.9 | 82 | 1880 | 1370 |
| 34 | Ta(3)+Re(3) | 1800 | 200 | Vacuum | 99.9 | 80 | 1850 | 1220 |
| 35 | Ta(3)+Nb(3) | 1800 | 200 | Vacuum | 99.6 | 80 | 1850 | 1280 |
| 36 | Re(3)+Nb(3) | 1800 | 200 | Vacuum | 99.8 | 83 | 1870 | 1290 |
| 37 | Mo(2)+Ta(2)+Re(2)+Nb(2) | 1800 | 200 | Vacuum | 99.9 | 85 | 1800 | 1150 |

[c]See footnote for Table 2.

What is claimed is:

1. A sintered body of a powdery mixture composed essentially of (a) 100 parts by weight of titanium diboride, (b) from 0.5 to 15 parts by weight of an alloy of nickel and phosphorus containing from 3 to 25% by weight of phosphorus based on nickel, and (c) from 1 to 95 parts by weight of at least one metal selected from the group consisting of chromium, molybdenum, niobium, tantalum, hafnium, rhenium and aluminum or at least one metal diboride selected from the group consisting of chromium diboride, molybdenum diboride, niobium diboride, tantalum diboride, hafnium diboride, rhenium diboride and aluminum diboride.

2. The sintered body as claimed in claim 1 wherein the amount of the metal as the component (c) is in the range from 1 to 10 parts by weight per 100 parts by weight of the component (a).

3. The sintered body as claimed in claim 1 wherein the amount of the metal diboride as the component (c) is in the range from 3 to 95 parts by weight per 100 parts by weight of the component (a).

4. The sintered body as claimed in claim 1 wherein the metal as the component (c) is selected from the group consisting of chromium, molybdenum, niobium, tantalum and rhenium.

5. The sintered body as claimed in claim 1 wherein the metal diboride as the component (c) is selected from the group consisting of chromium diboride, tantalum diboride, hafnium diboride and aluminum diboride.

6. A method for the preparation of a sintered body which comprises (i) intimately admixing (a) 100 parts by weight of titanium diboride, (b) from 0.5 to 15 parts by weight of an alloy of nickel and phosphorus containing from 3 to 25% by weight of phosphorus based on nickel, and (c) from 1 to 95 parts by weight of at least one metal selected from the group consisting of chromium, molybdenum, niobium, tantalum, hafnium, rhenium and aluminum or at least one metal diboride selected from the group consisting of chromium diboride, molybdenum diboride, niobium diboride, tantalum diboride, hafnium diboride, rhenium diboride and aluminum diboride into a powdery mixture, (ii) molding the powdery mixture into a shaped body, and (iii) subjecting the shaped body to sintering by heating at a temperature in the range from 1500° to 2000° C. for 10 to 60 minutes.

7. The method as claimed in claim 6 wherein the steps (ii) and (iii) are conducted simultaneously under compression of the powdery mixture with a pressure in the range from 50 to 300 kg/cm$^2$.

8. The method as claimed in claim 6 wherein the step (iii) is conducted in vacuum.

9. The method as claimed in claim 6 wherein the step (iii) is conducted in an atmosphere of a reducing gas.

10. The method as claimed in claim 9 wherein the reducing gas is hydrogen.

* * * * *